US005714210A

United States Patent [19]

Watkins

[11] Patent Number: 5,714,210

[45] Date of Patent: Feb. 3, 1998

[54] VARIABLE WIDTH STREAMERS

[76] Inventor: James O. Watkins, 14290 Mt. Nebo Rd., Poolesville, Md. 20837

[21] Appl. No.: 412,684

[22] Filed: Mar. 29, 1995

[51] Int. Cl.[6] ..... A63H 37/00

[52] U.S. Cl. ..... 428/7; 156/250; 428/906

[58] Field of Search ..... 428/906, 7; 446/475; 206/394, 410; 156/250

[56] References Cited

U.S. PATENT DOCUMENTS

| | | | |
|---|---|---|---|
| 454,316 | 6/1891 | Wheeler | 206/394 |
| 1,464,426 | 8/1923 | Hemmerdinger | 206/394 |
| 2,823,444 | 2/1958 | Davies et al. | 428/906 X |
| 4,113,906 | 9/1978 | Brandwein | 428/43 X |
| 4,826,712 | 5/1989 | Theno | 428/906 X |
| 4,923,216 | 5/1990 | Cedar | 428/603 X |
| 5,041,317 | 8/1991 | Greyvenstein | 428/906 X |
| 5,066,529 | 11/1991 | Huber et al. | 428/906 X |
| 5,186,988 | 2/1993 | Dixon | 428/906 X |
| 5,354,227 | 10/1994 | Watkins | 428/906 X |
| 5,620,354 | 4/1997 | Watkins | 446/475 |

*Primary Examiner*—Henry F. Epstein
*Attorney, Agent, or Firm*—Ronald B. Sherer

[57] ABSTRACT

An amusement streamer is disclosed in which portions of the streamer of greater and lesser widths are disposed along the length of the streamer.

27 Claims, 3 Drawing Sheets

VARIABLE WIDTH STREAMERS

FIELD OF THE INVENTION

The present invention relates to party streamers, and more particularly, to streamers having variable widths such that the elongated streamer appears to the eye of the observer as a series or train of separate pieces flying through the air. The present invention also relates to a method of forming such variable width streamers, and to a method for cutting streamers from plastic films such that the cut edges of the streamer are not fused to each other.

BACKGROUND

Party streamers comprising rolls of tissue paper have long been known and used at festive occasions such as parties, sporting events, and weddings. Such streamers comprise elongated strips of paper or tissue paper, usually having a width in the order of ¼ to ½ inch, which are wound about a core to form a roll. The roll may be hand-thrown, or launched from a cannon by compressed gas, such that the tumbling roll unwinds in the air. This tumbling action of the roll produces an elongated tail which progressively unwinds from the roll in the air such that the appearance to the eye of the observer is that of a comet flying through the air; ie, the roll being the comet head and the elongated strip being the tail of the comet.

Such streamers have an advantage relative to confetti in that streamers do not require as much effort to clean up after use since they are composed of one long piece rather than hundreds of small, individual pieces. However, streamers have had a distinct disadvantage in that they do not produce nearly as dramatic an effect as that produced by a burst of confetti. The main reason for this is that streamers have always been composed of strips of substantially equal and constant width such that the eye only sees one elongated strip with straight, parallel edges; ie, as opposed to many individual pieces when confetti is launched into the air.

SUMMARY

The present invention overcomes the above-indicated disadvantage by creating streamers which have unequal widths along their length. The shape of the unequal widths may be controlled such that streamers may be produced which appear to the eye of the observer as being a long string of individual pieces of confetti. Various shapes may be produced including diamond shapes and those which appear as an elongated swirl of individual pieces, and which promote a twirling action of the streamer about its longitudinal axis as it flies through the air. These and other objects and advantages will become apparent from the following description of several embodiments of the invention as illustrated in the following drawings.

DETAILED DESCRIPTION

Figure 1:
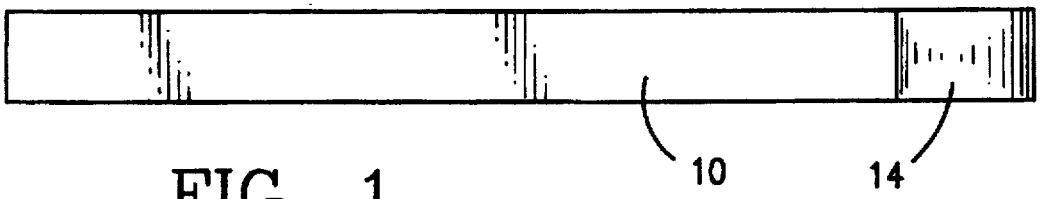
FIG. 1 PRIOR ART
FIG. 1 is a top plan view of a streamer of the prior art.
Figure 2:
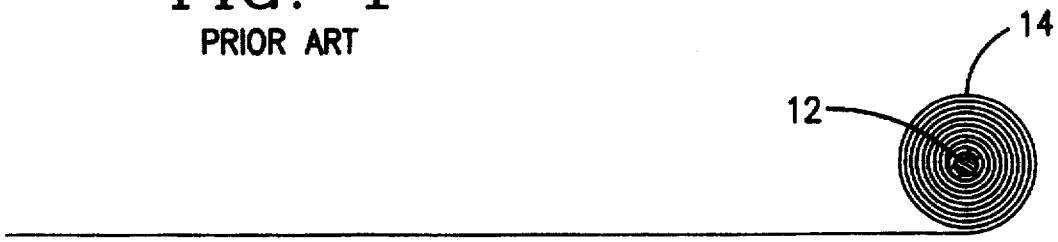
FIG. 2 PRIOR ART
FIG. 2 is a side view of a streamer of the prior art.

FIGS. 1 and 2 illustrate a streamer of the prior art which comprises an elongated strip 10 of tissue paper which is wound about a central core 12 to form a streamer roll 14. When streamer roll 14 is projected into the air, the strip 10 progressively unwinds from the roll and appears as a tail on a comet flying through the air. However, since strip 10 is of uniform width, the tail appears as an integral, elongated, one-piece strip; ie, as opposed to a large plurality of pieces as in the use of confetti.

Figure 3:
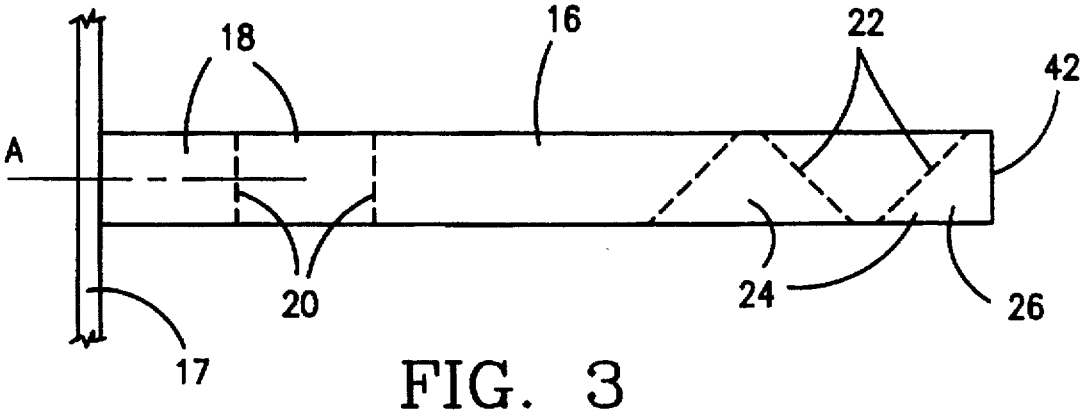
FIG. 3 is a top plan view of an elongated, wound cylinder to be cut into individual streamer rolls.
Figure 4:
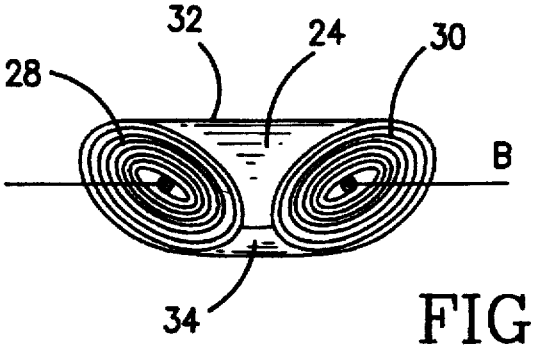
FIG. 4 is a front elevational view of one streamer roll of the present invention.
Figure 5:
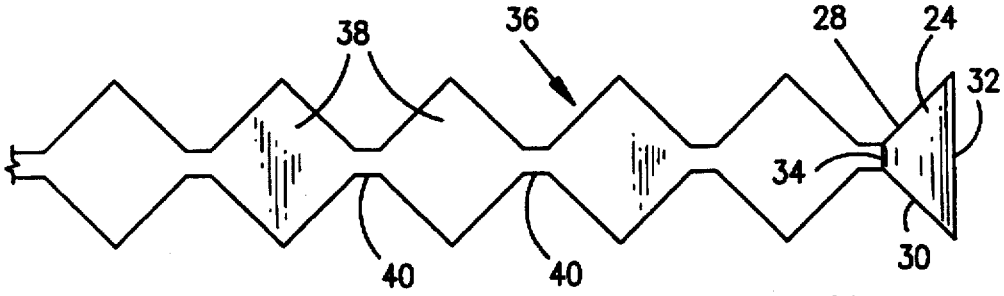
FIG. 5 is a top plan view of one form of streamer of the present invention.
Figure 6:
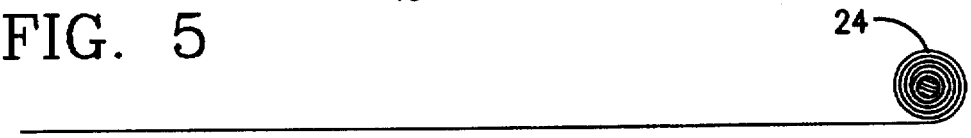
FIG. 6 is a side view of the streamer of FIG. 5.

Referring to FIG. 3, numeral 16 indicates an elongated cylindrical roll of wound paper, tissue paper, or plastic film such as Mylar or PVC film. Cylindrical roll 16 is sometimes referred to as a "log" because of its elongated, cylindrical shape, and the end of the log is shown as abutting the backstop 17 of a cutting machine. Conventional streamers are made by cutting the log into shorter rolls 18, and great difficulty has been encountered in cutting plastic films as will be further explained. Such cutting is performed along dotted lines 20 which extend transverse to the longitudinal axis A of the log. However, in the present invention, log 16 is cut along dotted lines 22 which extend at an angle with respect to axis A. As a result, wedge-shaped streamer rolls 24 are produced, along with half wedge-shaped streamer rolls 26 at the ends of the log. A front view of one wedge-shaped roll 24 is shown in FIG. 4, and top and side views are shown in FIGS. 5 and 6, respectively. For purposes of describing the geometry of wedge-shaped rolls 24,it will be noted that each wedge-shaped roll is generally of cylindrical shape having cut end-surfaces 28, 30 with the cut end-surfaces extending at an angle with respect to the longitudinal axis B of the wedge-shaped roll. The angled cut of the ends results in the front and rear sides of the roll being substantially unequal. For example, as shown in FIGS. 4 and 5, the back side 32 may be in the order of 1–5 inches while the front side 34 may be in the order of a quarter of an inch or less.

When streamer rolls 24 unroll in flight, as shown in FIG. 5, the strip or tail 36 unwinding from the streamer roll has the appearance of a large plurality of diamond-shaped pieces 38 connected by short, narrow portions 40. As a result, the tail no longer appears as one strip, but rather, the tail appears as a large number of individual diamond-shaped pieces following each other through the air; ie, as a train of invisibly connected separate pieces. In this regard, it should also be understood that the proportions of the widths of the diamonds 38 and the narrow connecting portions 40 is but one example. In practice, the widths of the diamond portions may be 1 to 5 inches, and the widths of the connecting portions may be in the order of ⅛ to 1 inch, and preferably ¼ to ½ inch. Thus, the wide portions may make the connecting portions virtually invisible as the streamer flies through the air. Also, as the tail 36 unwinds toward the core, the connecting portions disappear and the diamond portions are directly connected with no intermediate portions 40.

Figure 7:
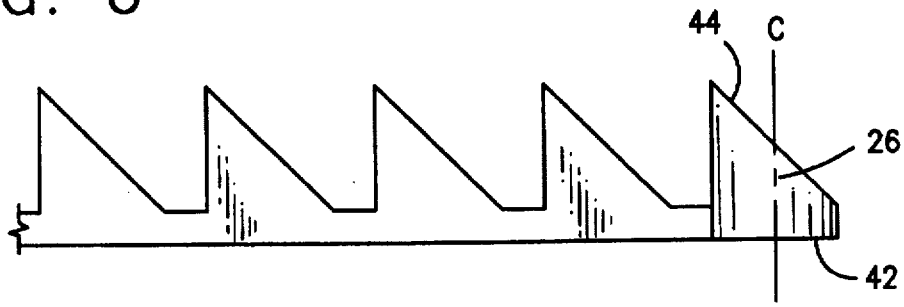
FIG. 7 is a top plan view of an alternate form of the streamer of the present invention.
Figure 8:
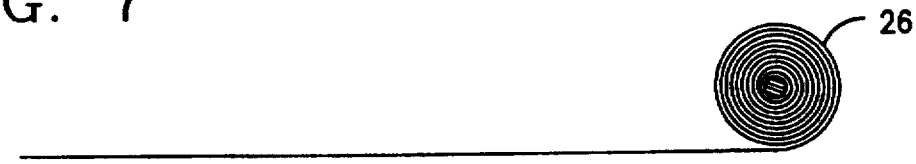
FIG. 8 is a side view of the streamer of FIG. 7.

Referring back to FIG. 3, end-piece 26 forms another shape when unrolled as shown in FIG. 7. This shape may be best described as a "saw-tooth," or "shark-fin" shape, and is most unusual and eye-catching as it flies through the air. The geometry of roll 26 may be described as being a rolled cylinder having one end surface 42 extending perpendicularly to the longitudinal axis C, and the opposite end surface 44 extending at an angle with respect to axis C.

In describing the foregoing shapes, it has been assumed that the composition of the rolled strip is that of paper or tissue paper. With these materials, the sharp points of the diamond and shark fin shapes result from the cuts as described. However, the cutting of plastic films such as Mylar and PVC film are quite different. First, referring to the left side of FIG. 3, prior attempts to cut such rolled plastic film materials along dotted lines 20 perpendicular to axis A have been largely unsuccessful. This is due to the fact that the knife blade of the cutter crushes the roll as it cuts through the roll, and the resulting cut end surface becomes jagged and/or the cut edges tend to fuse together. As a result, streamer rolls 18 of plastic film perform very poorly, if at all, because the jagged and/or fused edges inhibit the roll from unwinding smoothly, or anywhere near completely, in the air.

In the present invention, this serious problem is eliminated and the wedge-shaped streamer rolls 24 can be made from plastic film materials such as Mylar and PVC film such that they perform very well in smoothly and completely unrolling in the air. That is, it has been unexpectedly discovered that, when a log 16 of rolled plastic film is cut along an angled cut line such as one of dotted lines 22, the resulting cut surface does not become sufficiently jagged or fused such as to inhibit the unrolling of the strip in the air. While the reasons are not fully understood, and form no part of the present invention, it is believed that the cleaner cut results from the core and inner wrapped layers of the roll being able to slide along the direction of axis A as the blade cuts through the roll. In any event, the discovered fact is that streamers which unroll smoothly and completely can now be made from plastic films, including films with metallic coatings which are bright colored and very shiny as they fly through the air with the enlarged portions, such as the diamond-shaped portions, rapidly twisting relative to each other because of the narrow and flexible connecting portions.

Figure 9:
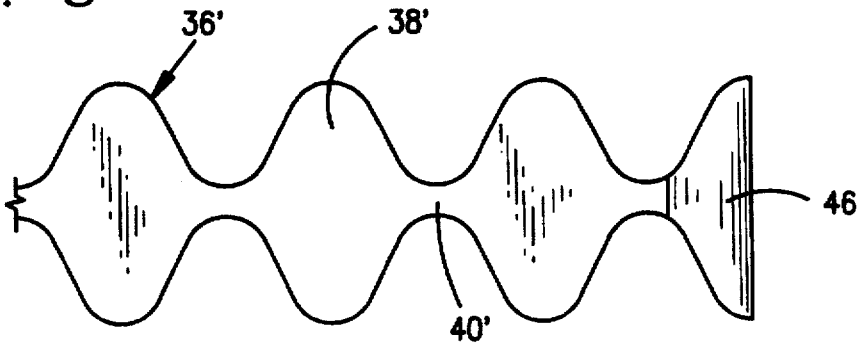
FIG. 9 is a top plan view of a further alternate form of the streamer of the present invention.
Figure 10:
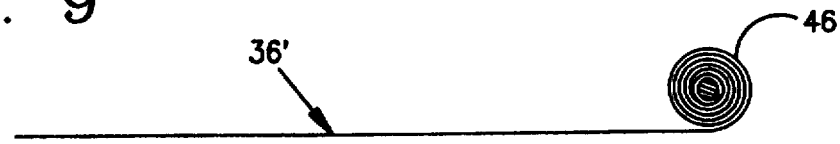
FIG. 10 is a side view of the streamer of FIG. 9.

Another difference which results from the use of rolled plastic films is that, because of the sliding or shifting of the core and inner wrapped layers as just described, the otherwise sharp points can be made rounded as illustrated in FIG. 9. Such rounding of the corners and connection portions has been discovered to occur with plastic films even though the shape of the wedge-shaped roll 46 is exactly the same as previously described with respect to roll 24 of FIGS. 3–5 composed of paper or tissue paper.

Figure 11:
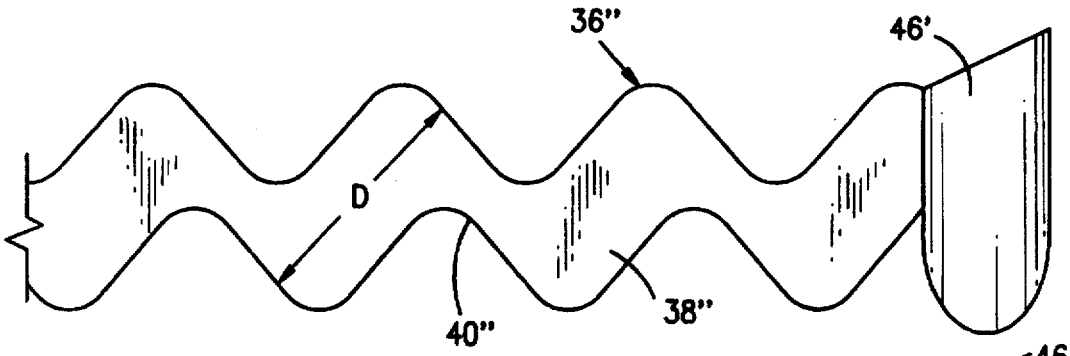
FIG. 11 is a top plan view of a further alternate form of the streamer of the present invention.
Figure 12:
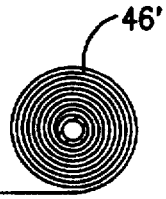
FIG. 12 is a side view of the streamer of FIG. 11.
Figure 13:
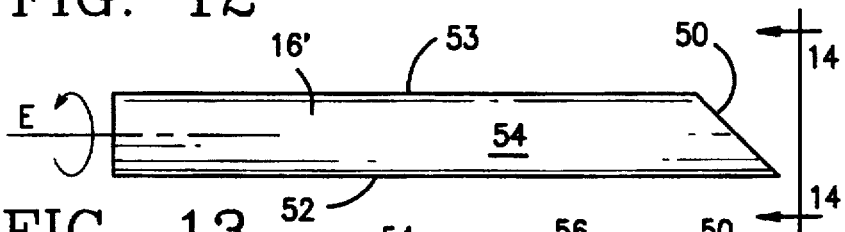
FIG. 13 is a top plan view of an elongated wound cylinder in the first step of being cut to form the streamer of FIG. 11.
Figure 14:
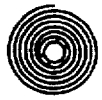
FIG. 14 is an end view of the cylinder taken along view line 14—14.
Figure 15:
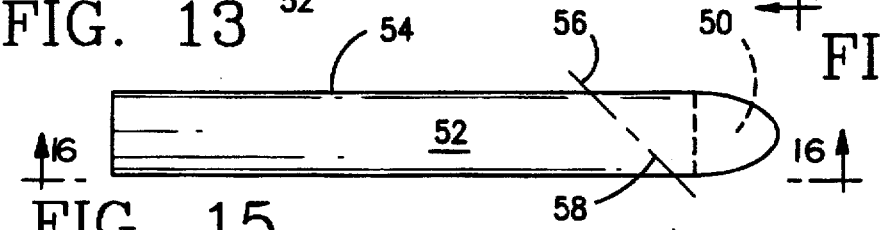
FIG. 15 is a top plan view of the same elongated wound streamer having been rotated 90 degrees about its longitudinal axis for a second cutting.
Figure 16:
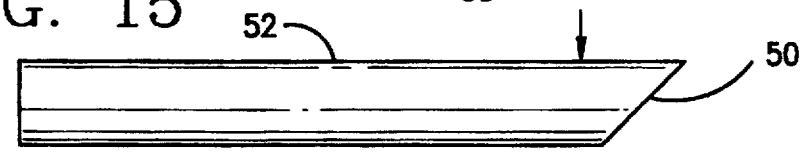
FIG. 16 is a side view of the once-cut cylinder taken along view line 16—16.

A further unique shape of streamer is illustrated in FIGS. 11 and 12. This shape is best described as being "swirl-shaped" and comprises relatively wide portions 38" connected by narrow portions 40". Wide portions 38" are generally rectangular, with rounded corners, and the longitudinal axis D of each rectangular portion extends at an angle with respect to the longitudinal length of strip 36". In addition to presenting an unusual shape of streamer, the streamer of FIG. 11 flies through the air with the rectangular portions 38" twisting relative to each other and also tends to rotate the entire tail about its longitudinal length thereby adding a unique swirling form of motion to the unique shape.

The swirl-shaped streamer of FIGS. 11–12 is manufactured as shown in FIGS. 13–16. A wound log 16' composed of plastic film, or tissue paper, is cut on an angle with respect to longitudinal axis E to form cut end surface 50. Then, instead of rotating the log 180° about axis E, such that front side 52 becomes the back side and the second cut is made to form the wedge-shaped streamer of FIGS. 3–5, log 16' is rotated 90° so that top side 54 becomes the back side, and the second cut is made along angled cut line 56; all cuts being made vertically downward from the top of the log to the bottom of the log. The resulting rolled streamer comprises a short cylinder having the first cut end surface 50 extending in one plane at angle to axis E, and a second cut end surface 58 extending in second plane at an angle to axis E such that the cylindrical streamer roll comprises what is known as a compound miter cut.

Figure 17:
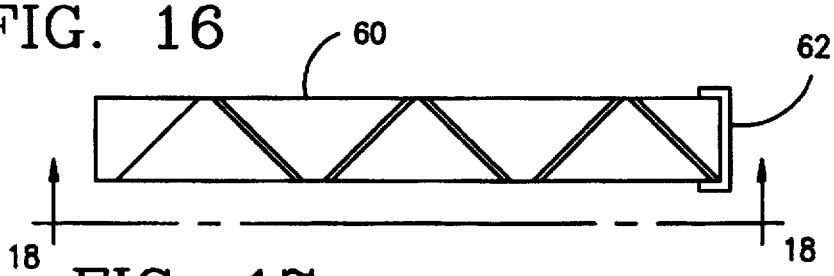
FIG. 17 is a top plan view of a clear, hollow plastic tube containing a plurality of streamer rolls of the present invention.
Figure 18:
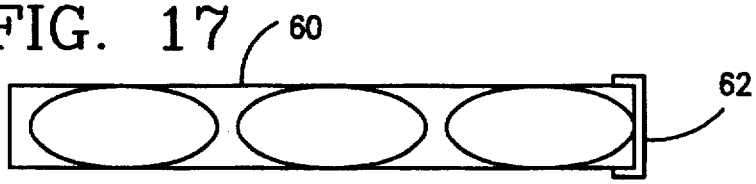
FIG. 18 is a side view of the tube of FIG. 17 taken along the view line 18—18.

While the streamer rolls of the present invention may be thrown by hand 15–20 feet into the air such as to fly through an arcuate, comet-like path in the air, greater heights may be obtained by launching them from compressed gas cannons, or by launching from hand-held hollow tubes or wands as disclosed in U.S. Pat. No. 5,354,227, the complete disclosure of which is hereby incorporated by reference. For example, a plurality of wedge-shaped rolls may be inserted into a hollow plastic tube 60 having a cap 62 as shown in FIGS. 17 and 18. Preferably, the plurality of rolls 24, 26, 46 and/or 46' are composed of wound strips of different colors, and tube 60 may be composed of clear plastic, whereby the colored diamond and other shaped rolls show through the clear tube and present a unique Harlequin pattern which is very distinctive and pleasing prior to, as well as during, launching of the streamer rolls into the air.

While cut lines 22 of FIG. 3 and cut lines 50, 56 of FIGS. 13–16 have been illustrated, byway of example, as being 45 degree angles with respect to axes A and E of logs 16 and 16', respectively, it has been determined that angles of 15–60 degrees may be employed, and that angles of 30–45 degrees are preferred to produce the most striking and unusual shapes of the tail as it unwinds from the streamer roll in flight.

From the foregoing description of several illustrative embodiments of the invention, it will be apparent that numerous variations will become apparent to those skilled in the art of manufacturing streamers. Therefore, it is to be understood that the foregoing description is intended to be purely illustrative of the principles of the invention, rather than limiting thereof, and that the invention is not to be limited other than as set forth in the following claims as construed under the doctrine of equivalents.

What is claimed is:

1. An amusement streamer comprising a wound strip of lightweight material forming a roll, said roll being of cylindrical shape and having a central axis about which said strip is wound, said roll having cut end-surfaces at each end of said central axis, and said cut end-surfaces extending in non-parallel planes.

2. The amusement streamer of claim 1 wherein at least one of said non-parallel planes extends at an angle in the order of 15°–60° with respect to said central axis.

3. The amusement streamer of claim 1 wherein both of said non-parallel planes extend at angles in the order of 15°–60° with respect to said central axis.

4. The amusement streamer of claim 1 wherein said strip of lightweight material has a shape comprising a plurality of first portions having a first width, a plurality of second portions having a width substantially smaller than said first width, and said first portions being connected to each other along the length of said strip by said second portions.

5. The amusement streamer of claim 4 wherein said plurality of first portions are diamond-shaped.

6. The amusement streamer of claim 4 wherein said plurality of first portions are diamond-shaped with rounded corners.

7. The amusement streamer of claim 4 wherein said plurality of first portions are sawtooth-shaped.

8. The amusement streamer of claim 4 wherein said plurality of first portions are tetragonal-shaped.

9. The amusement streamer of claim 8 wherein each of said tetragonal-shaped portions have a length and a width, and the lengths of said tetragonal-shaped portions extend at angles with respect to the length of said strip.

10. An amusement streamer manufactured by the method of:

(a) rolling a substantial length of lightweight material to form an elongated wound cylinder of said material, said elongated wound cylinder having a central axis about which said material is wound;

(b) cutting said wound cylinder along a cut line, said cut line extending at an angle with respect to said axis;

(c) rotating said wound cylinder at least 90° about said axis; and (d) cutting said wound cylinder a spaced distance along said axis from said first cut line, said second cutting being along a second cut line, and said second cut line extending at an angle with respect to said first cut line.

11. The amusement streamer of claim 10 wherein said lightweight material is plastic film.

12. The amusement streamer of claim 10 wherein said wound cylinder is rotated 180° about said axis.

13. The amusement streamer of claim 12 wherein said first and second cut lines extend at an angle in the order of 15°–60° with respect to said axis.

14. The streamer of claim 1 wherein said strip of lightweight material is a strip of plastic film.

15. The streamer of claim 14 wherein said plastic film is metalized plastic film.

16. A streamer for amusement purposes comprising in combination:

(a) a wound strip of material forming a roll;

(b) said strip of material consisting of plastic film;

(c) said roll being of cylindrical shape and having a central axis about which axis said strip is wound;

(d) said cylindrical roll having cut end-surfaces at opposite ends of said central axis; and (e) said cut end-surfaces extending in non-parallel planes.

17. The streamer of claim 16 wherein said strip of plastic film is metalized plastic film.

18. The streamer of claim 16 wherein the angles between each of said planes and said central axis is in the order of 15 to 60 degrees.

19. The streamer of claim 18 wherein said angles are in the order of 30 to 45 degrees.

20. The streamer of claim 16 wherein said cylindrical roll includes first and second side portions extending parallel to and on opposite sides of said central axis, and wherein the axial length of said first side portion is in the order of 1 to 5 inches and the axial length of said second side portion is in the order of one-eighth to one inch.

21. A streamer for amusement purposes comprising:

(a) an elongated strip of lightweight material;

(b) said elongated strip being wound to form a streamer roll;

(c) said strip comprising a large plurality of first portions having first widths and a large plurality of second portions having second widths;

(d) said first portions being connected to each other along the length of said elongated strip by said second portions; and (e) said first portions having widths substantially greater than the widths of said second portions such that, when said streamer roll unwinds in the air and said elongated strip unwinds from said streamer roll, said first portions appear substantially more visible than said second portions.

22. The streamer of claim 21 wherein the widths of said second portions are sufficiently small such as to become substantially invisible such that said first portions appear as a train of separate pieces flying through the air.

23. The streamer of claim 21 wherein said strip of lightweight material is composed of plastic film.

24. An amusement streamer comprising:

a) an elongated strip of lightweight material;

b) said elongated strip of lightweight material being wound about a central axis to form a cylindrical roll;

c) said elongated strip of lightweight material having an elongated length, a thickness and a plurality of unequal widths, said unequal widths extending perpendicular to said elongated length and parallel to said central axis such that said elongated strip has variable width portions of relatively larger and relatively smaller widths.

25. The amusement streamer claim 24 wherein the portions of relatively larger width are generally diamond-shaped.

26. The amusement streamer of claim 24 wherein the portions of relatively larger width are generally rectangular and connected to each other by the portions of relatively smaller widths.

27. The amusement streamer of claim 24 wherein said portions of relatively larger widths have widths in the order of 1 to 5 inches, and wherein said portions of relatively smaller widths have widths in the order of ⅛ to 1 inch.

* * * * *